United States Patent [19]

Lerner et al.

[11] 4,133,725

[45] Jan. 9, 1979

[54] LOW VOLTAGE HARD ANODIZING PROCESS

[75] Inventors: Moisey M. Lerner, Brookline; James H. Morse, Holliston, both of Mass.

[73] Assignee: Sanford Process Corporation, Natick, Mass.

[21] Appl. No.: 906,921

[22] Filed: May 18, 1978

[51] Int. Cl.[2] ..... C25D 11/04

[52] U.S. Cl. ..... 204/58; 204/DIG. 8

[58] Field of Search ..... 204/58, DIG. 8

[56] References Cited

U.S. PATENT DOCUMENTS

| | | | |
|---|---|---|---|
| 2,743,221 | 4/1956 | Sanford | 204/58 |
| 2,897,125 | 7/1959 | Franklin | 204/58 |
| 2,905,600 | 9/1959 | Franklin | 204/58 |
| 2,977,294 | 3/1961 | Franklin | 204/58 |
| 3,020,219 | 2/1962 | Franklin | 204/58 |

FOREIGN PATENT DOCUMENTS

| | | | |
|---|---|---|---|
| 548071 | 10/1957 | Canada | 204/58 |

OTHER PUBLICATIONS

DFBO-Mitteilungen, "Hartanodisation mit Wechsel-stromübertagerung," Sep. 10, 1973, pp. 174–182.

Light-Metals, "Hard Surfacing Light Alloy by Anodizing," Feb. 1952, pp. 46–48.

*Primary Examiner*—R. L. Andrews

*Attorney, Agent, or Firm*—Weingarten, Maxham & Schurgin

[57] ABSTRACT

A process for hard anodizing of aluminum and aluminum alloys by use of a low voltage having a DC component and a superimposed AC component. The electrolyte can have relatively low acid concentration and can be of higher temperature than usually employed for hard anodizing.

17 Claims, 7 Drawing Figures

LOW VOLTAGE HARD ANODIZING PROCESS

FIELD OF THE INVENTION

This invention relates to anodizing processes and particularly to a process for the hard anodizing of aluminum and aluminum alloys in electrolytes containing strong acids.

BACKGROUND OF THE INVENTION

Anodizing of aluminum and aluminum alloys is accomplished by immersing articles to be anodized in an electrolyte, connecting the articles to one terminal of a power supply, this terminal being positive during an entire anodizing cycle or portion thereof, and connecting the cathode in the electrolyte to the other terminal of the power supply. The characteristics or properties of the oxide film produced on the surface of aluminum and aluminum alloy articles can change dramatically depending upon the composition of the electrolyte, its temperature, the waveform of the applied voltage, and the program under which the voltage is varied. In the present specification, the term "aluminum" is used to include the alloys of that metal unless the text indicates otherwise.

A very thin and nonporous oxide film is formed on an aluminum article when a water solution of a weak acid, which does not dissolve the oxide film, is used for anodizing. Weak acids include boric acid, citric acid, etc. Thickness of the oxide film in this case, is generally less than one micron and the dielectric properties of this thin coating improve with the increased purity of the aluminum being coated.

Porous and much thicker oxide films are obtained when aluminum articles are anodized in water solutions of strong acids, which do partially dissolve the oxide film simultaneously with its formation. Such strong acids include sulfuric acid, chromic acid, oxalic acid etc. In this case, the thickness of anodized coatings may be from several microns to hundreds of microns. The properties of these thick coatings are strongly dependent on the temperature of the electrolyte. At room temperature (about 70° F. or 20° C.) a rather soft oxide film is produced, with a thickness ordinarily in the range of about 8–10 microns. A low DC voltage of about 15–18 volts is used in this case for anodizing. Anodizing, under the conditions just described, is called "conventional anodizing" and is widely used when the appearance or corrosion resistant properties of the oxide surface are of primary importance rather than the mechanical properties of the oxide film.

About three decades ago it was first discovered that very hard oxide films with a sapphire hardness may be obtained if the temperature of the electrolyte is about 32° F. or less. In the years following, this discovery has been implemented and successfully employed in what has come to be known as "hard anodizing processes." While different in details, all hard anodizing processes have certain common features.

A much higher voltage than that of conventional anodizing is employed in a hard anodizing process, because the input resistance of the immersed system has an increased resistance at low temperatures which requires more voltage to achieve a given current level in the system. Usually such high voltage cannot be initially applied to the articles being anodized. The initial voltage is usually no more than about 10–20 volts since at higher voltages a deteriorated oxide coating is produced or the aluminum article can start "burning", which is the catastrophic dissolving of the aluminum. The final voltage may reach nearly 100 volts at the ends of a hard anodizing cycle, the specific final voltage depending on the particular alloy, its temper, and the film thickness. Thus, in a hard anodizing process. The voltage is gradually raised from an initial value to a final value to produce the intended oxide coating without burning of the articles. It is very probable that anodizing with a gradually increased voltage does not enable the provision of an oxide film with a homogeneous structure. As indicated in the article by Keller, Hunter and Robinson in the *Journal of the Electrochemical Society,* Volume 100, 1953, pages 411–419, the oxide film formed in strong electrolytes has a cell structure, each cell being hexagonal with a pore in its center, the pore being perpendicular to the aluminum surface. The distance between pores of adjacent cells is proportional to the applied anodizing voltage. As a result, the oxide film formed by a non-constant voltage will have a non-uniform structure gradually changing as the voltage and the thickness of the oxide film increases. Therefore, the properties of this oxide film are believed to be inferior to those of films having a homogeneous structure.

In addition to the higher anodizing voltage, a hard anodizing process employs a rather high concentration of a strong acid in the electrolyte to provide an electrolyte having reasonable "universality". By the "universality" of the electrolyte, it is meant that any alloy irrespective of its composition or temper can be hard anodized with the same acid concentration. Some alloys, however, especially those with a high copper content, would not be hard anodized as readily as other alloys if both the acid concentration and the temperature of the electrolyte are lowered to a certain degree. A universal electrolyte preferably includes a concentration of sulfuric acid of about 300 grams per liter or more and at temperatures about 32° F. Such high acid concentration can prevent the formation of oxide films with more than 50–60 microns thickness on some alloys.

An especially effective technique for providing a universal hard anodizing electrolyte is the addition to the electrolyte of an organic extract sold under the trademark "SANFRAN" and produced by the *Sanford Process Corporation.* This additive is an acidic aqueous extract obtained by boiling a mixture of brown coal, lignite, or peat in water, and the process for obtaining such extract is described in U.S. Pat. No. 2,743,221. The hard anodizing process using the Sandord acidic aqueous extract is now widely employed in the United States and in foreign countries and has become known as the Sanford Process. This process is further described in U.S. Pat. Nos. 2,897,125; 2,905,600; 2,977,294; and 3,020,219.

It would be of great practical benefit to provide a hard anodizing process in which the amount of electrical power required for the process is reduced in order to reduce the cost of consumed electrical energy. The cost factor is especially important by reason of the greatly increased cost of electrical energy during recent years and the expectation of still further increases of energy cost in the future. During a hard anodizing process, about half of the electrical energy is consumed by the electrochemical process of forming the oxide film itself, as governed by Faraday's Law, while the other half of the electrical energy is consumed by the refrigeration system used to control the temperature of the electrolyte. A reduction in the amount of electrical energy consumed by the hard anodizing process can be achieved if the anodizing voltage is reduced, without sacrificing either the speed of anodizing or the quality of the anodic oxide film. Further reduction of consumed electrical energy can be provided if the temperature of the electrolyte is increased without diminishment of anodizing speed or resulting quality of the oxide film.

A disadvantage of an electrolyte of high acid concentration is the increased cost of waste water treatment which is required to meet modern antipollution standards. It is therefore extremely desirable to reduce the acid concentration required for providing an oxide film on aluminum alloys and to reduce the cost of waste water treatment without sacrificing the ability to anodize different alloys in the same electrolyte.

SUMMARY OF THE INVENTION

In brief, the present invention provides a method for hard anodizing of aluminum and aluminum alloy articles by use of low anodizing voltage which is composed of a DC component and a superimposed AC component, and employing a cooled electrolyte which can have relatively low acid concentration. By virtue of the novel process, hard anodized coatings are provided with a homogeneous structure having superior characteristics in comparison with conventionally formed hard anodic coatings. The novel process also provides hard anodized coatings which are thicker and of higher quality than those obtained by conventional processes.

In accordance with the invention, articles of aluminum or aluminum alloys are immersed in an electrolyte and are connected to one terminal of a power supply providing a DC voltage with a superimposed AC voltage, the other terminal of the power supply being connected to the cathode of the anodizing system in the electrolyte. The terminal to which articles are connected is positive in reference to the DC component, while the terminal connected to the cathode is negative in reference to the DC component. During an anodizing cycle, the DC voltage has a value during at least a portion of the cycle in the range of about 14–20 volts, the particular value depending on the composition of the article, its temper, the concentration of the electrolyte and electrolyte temperature. This DC value is the greatest DC voltage component applied across the article during the anodizing cycle. If the rack to which the article is connected has a high resistance, a higher than the above-specified voltage should be applied across the system rack — article — electrolyte — tank so that the voltage drop across the anodized article itself would be in the range of about 14–20 volts. Usually, the power supply voltage is raised either continuously or stepwise until the DC component reaches a predetermined value in the intended range from about 14–20 volts, and the DC voltage is then kept constant for the remainder of the anodizing cycle. Preferably the AC component is sinusoidal and of a ratio of its amplitude to the DC component level of about 100%.

The electrolyte has an acid concentration much lower than customarily employed for hard anodizing and is at an operating temperature higher than the temperature employed in conventional hard anodizing. Even greater improvement in the quality of resulting oxide film can be provided if an acidic aqueous extract, such as the SANFRAN additive described above, is added to the electrolyte.

The novel process is operative at voltages much less than those usually employed for hard anodizing and thus the power consumption is correspondingly reduced by use of the present process. Power consumption is also reduced by virtue of the operation of the novel process with an electrolyte of higher temperature than usually employed for hard anodizing. In addition, the cost of waste water treatment is reduced from that of conventional systems since the electrolyte can have a lower acid concentration.

DESCRIPTION OF THE DRAWINGS

The invention will be more fully understood from the following detailed description and the accompanying drawings, in which.

DETAILED DESCRIPTION OF THE INVENTION

Figure 1:
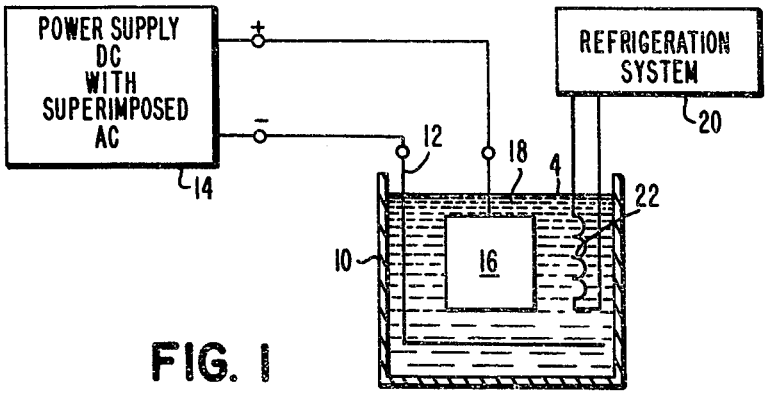
FIG. 1 is a diagramatic representation of apparatus for practicing the invention.

Prior to the introduction of articles to be hard anodized in an electrolytic bath, the articles are cleaned in accordance with well known preparatory procedures. The cleaned articles are then immersed in the electrolytic bath and connected to the anodizing system power supply. Apparatus for practice of the novel process is shown schematically in FIG. 1 and includes a tank 10 containing an electrolyte 18 and having immersed therein a cathode or counter-electrode 12 connected to one terminal of a power supply 14 which provides a DC voltage with superimposed AC voltage. The other terminal of power supply 14 is connected to one or more articles 16 immersed in electrolyte 18 and which are to be hard coated. A refrigeration system 20 is provided and includes cooling coils 22 immersed in electrolyte 18 for maintaining the electrolytic bath at a predetermined cooled temperature. In actual implementation, the apparatus can be of many different well-known forms. The tank 10 can itself be of a suitable metal to serve as the counter-electrode, rather than employing a separate electrode in the bath.

In preferred embodiment, the electrolyte 18 is an aqueous solution of sulfuric acid with a concentration of about 5.7–23% by volume. The electrolyte may also contain about 2–8% by volume of an organic acid additive such as that sold under the trademark SANFRAN. The electrolyte is cooled to a temperature in the range of about 25°–60° F. by refrigeration system 20. The electrolyte may be cooled by any known means such as by circulation of a refrigerating liquid through coils 22, or circulation of the electrolyte itself through a refrigeration system and return to the tank after having been cooled.

Figure 2A:
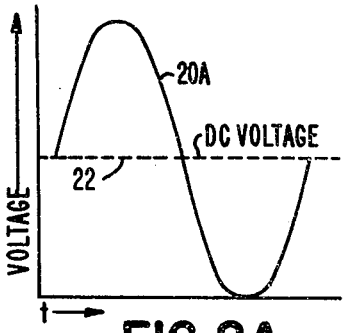
FIGS. 2A, 2B and 2C are waveform diagrams illustrating a DC voltage level with a superimposed AC voltage at different ratios of AC to DC.
Figure 2B:
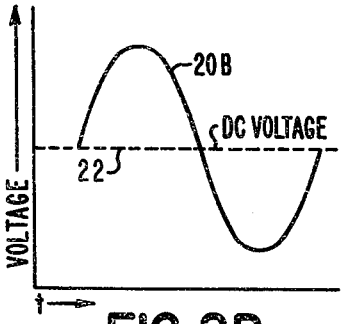
Figure 2C:
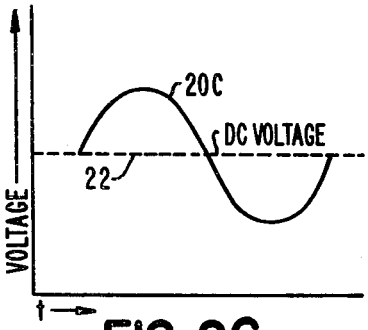

The power supply 14 provides a DC voltage with a superimposed AC voltage, the AC voltage preferably being sinusoidal and of an industrial frequency of 50 or 60 Hz. The power supply terminal connected to the articles 16 being anodized is positive with respect to the DC voltage component, while the counterelectrode is connected to the power supply terminal which is negative with respect to the DC voltage component. Preferably, but not necessarily, the AC voltage component should have a peak-to-peak magnitude of about 200% of the DC voltage level. As shown in FIG. 2A, the peak-to-peak value of the AC voltage component 20A is twice the value of the DC voltage level 22 and the ratio of the amplitude of the AC voltage component to the DC voltage component is therefore 100%. Other ratios of AC to DC voltage component values can be employed. As examples, ratios of 75% and 50% are respectively illustrated in FIGS. 2B and 2C.

The power supply 14 for providing a DC voltage having a superimposed AC voltage can be implemented by many different power supply circuits. An implementation is described in copending patent application Ser. No. 864,001, filed Dec. 23, 1977 by B. Frustajer and M. Lerner, and provides a relatively simple and inexpensive circuit for producing a DC voltage with superimposed sinusoidal voltage. A useful feature of this power supply is that the ratio of AC to DC voltage can be changed, and the ratio once set, can be maintained constant throughout the adjustable range of magnitudes of the DC voltage component.

In accordance with the invention, hard anodizing is accomplished at very low values of DC voltage component in the range of about 14–20 volts. The amplitude of the AC voltage component is preferably equal to the DC voltage component value but need not necessarily be so. The lesser the ratio of the AC to the DC voltage component, the greater the duration to complete the anodizing process. The anodizing process duration is also longer when the DC voltage component value is decreased. However, the anodizing time alone is not the most crucial factor in determining the performance or efficiency of the anodizing process. More importantly, the quality of the oxide film being formed is the major determinant in the process. It has been discovered that a particular anodizing voltage exists for each alloy which yields the best oxide film from the point of view of its abrasion resistance and breakdown voltage. The time of anodizing at this optimal voltage is not necessarily the shortest anodizing time.

Examples are set forth below of the novel anodizing process employed with different aluminum alloys. In each of the following examples the specimen article was a 4 × 4 × 0.04 inch flat plate of an aluminum alloy in accordance with Aluminum Association Standards and Data Book 1976–1977. The AC component of the anodizing voltage was sinusoidal with a frequency of 60 Hz, and the ratio of the amplitude of the sinusoidal component to the DC voltage component was 100% throughout the anodizing cycle.

EXAMPLE 1

Figure 3:
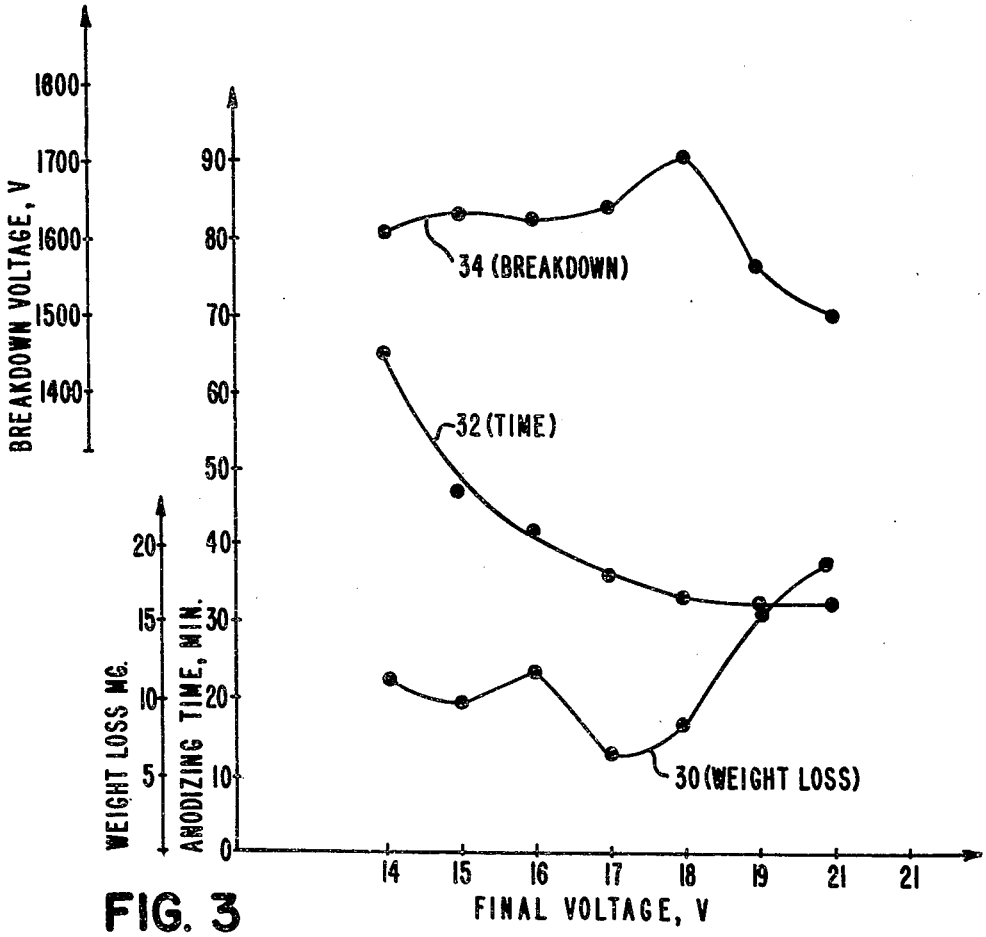
FIG. 3 illustrates plots of weight loss, duration of an anodizing cycle, and breakdown voltage as a function of final anodizing voltage for the 2024 aluminum alloy.

In this example, anodization of 2024 alloy was performed in an electrolytic bath, the temperature of which was maintained at 50° F. A 12% by volume of 66° Baume sulfuric acid was employed in the electrolyte, and a 3% by volume of SANFRAN was added to the electrolyte. During the first minute of anodization, the DC voltage component was raised from zero to 10 volts and then was increased at a constant rate of ½ volt per minute up to a final voltage which was then maintained constant for the remainder of the cycle. In FIG. 3, there are shown plots of weight loss (abrasion resistance), breakdown voltage, and time as a function of final DC voltage component. Anodizing was accomplished at different final voltages and durations but with the same amount of coulombs passed during each anodizing cycle; 12.5 ampere minutes per square inch. The thickness of the coating on all samples was approximately the same, 2.67 ± 0.11 mils. due to anodizing by the same amount of electricity, 400 ampere minutes.

The dependence of abrasion resistance on final voltage is shown by graph 30 of FIG. 3. Abrasion resistance was measured by the Taber Abrasion Test described in Method 6192 of Federal Test Method Standards No. 1410. The abrasion resistance is evaluated by the wear index which is computed using the following equation:

$$\text{wear index} = ((A-B)/C) \times 1000$$

where

A is the weight of the test specimen before abrasion;
B is the weight of the test specimen after abrasion; and
C is the number of cycles of abrasion.

Abrasion resistance may directly be defined by the anodic coating weight loss in milligrams after a specified number of cycles, which is 10,000 in the tests which were conducted. Weight loss is used as an inverse indication of wear resistance in graph 20.

Graph 32 of FIG. 3 shows the dependence of the duration of the anodizing cycle on final voltage. Graph 34 of FIG. 3 depicts the variation of breakdown voltage with final voltage. The breakdown voltage of the anodized coating was determined as an average of measurements at 16 locations on one side of the specimen, while employing a spherical electrode and using a DC voltage in accordance with the test procedure described in test standard ASTM B110-46.

As can be seen from graphs 30 and 34 of FIG. 3, the specimen which was anodized at a final DC voltage component of between 17 and 18 volts exhibited the minimum weight loss, and the maximum breakdown voltage. It is noted that the obtained minimum weight loss value, which was 6.4 milligrams, is much less than the allowed limit of 40 milligrams under Military Specification MIL-A-8625C. From graph 32 it is evident that the optimal oxide film was produced during a rather short anodizing time of 36 minutes. The graphs of FIG. 3 also denote a rather consistent change in breakdown voltage with respect to weight loss; that is, the greater the weight loss, the less the breakdown voltage and vice versa.

EXAMPLE 2

Figure 4:
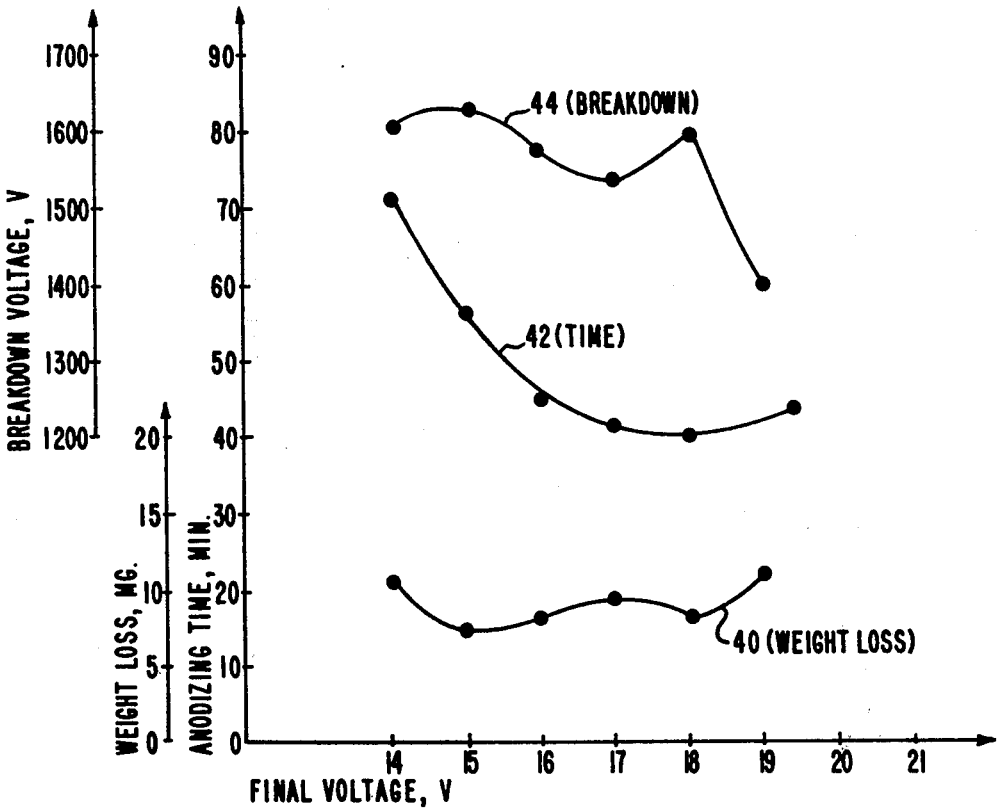
FIG. 4 shows plots similar to those of FIG. 3 but for the 6061 aluminum alloy.

In this example, the aluminum specimen was a plate of alloy 6061 and the process was identical with that of Example 1, the corresponding graphs of abrasion resistance, anodizing time and breakdown voltage being depicted in FIG. 4. As seen from graphs 40 and 44 of FIG. 4, the best quality oxide film is formed when the final DC voltage component is in the range of about 15–18 volts. From graph 42, the anodizing time is about 40 minutes. The thickness of the coatings produced in this example at 400 ampere minutes was 2.71 ± 0.09 mils.

EXAMPLE 3

Figure 5:
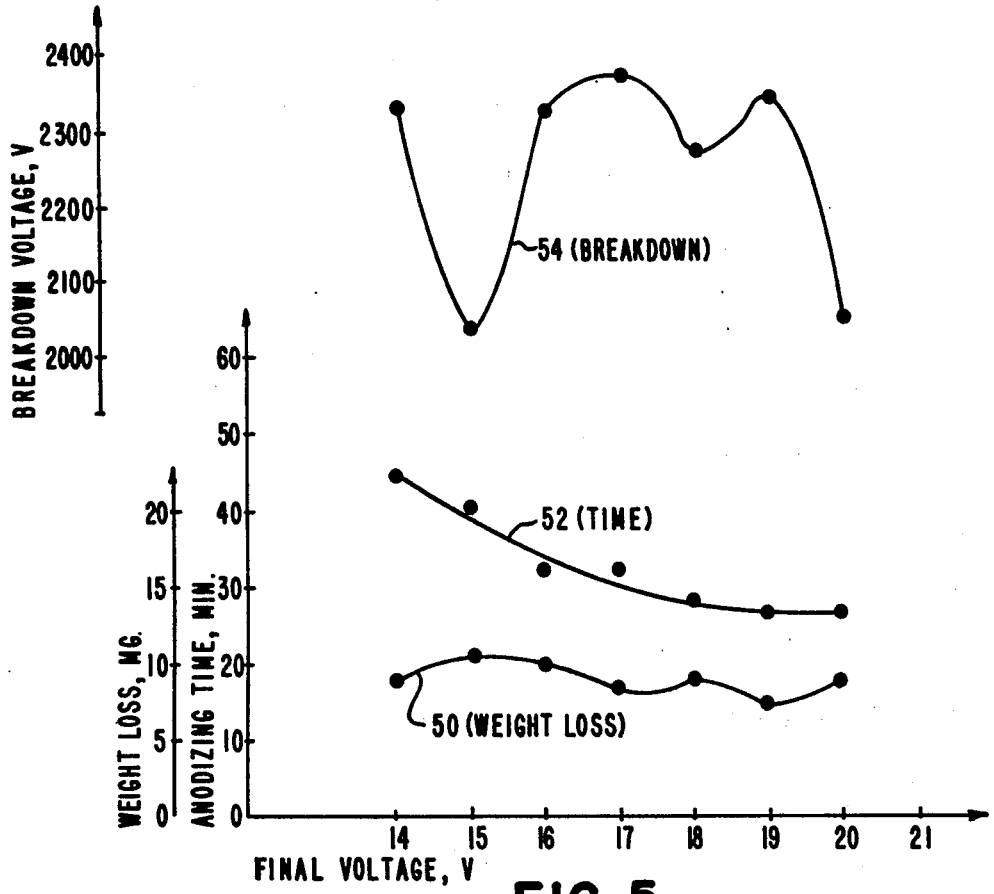
FIG. 5 shows plots similar to those of FIG. 2 but for the 7075 aluminum alloy.

The process was again identical to that employed in Example 1 except that the specimen was of 7075 alloy. Corresponding graphs are set forth in FIG. 5. It is seen from graphs 50 and 54 of FIG. 5 that the minimum weight losses and maximum breakdown voltages are at final respective voltages of about 17 and 19 volts, and that from graph 52 the anodizing time is about 30 minutes. The thickness of the anodic coatings obtained at 400 ampere minutes was 2.95 ± 0.127 mils.

In the novel hard anodizing process described above, thick high quality hard anodized coatings are provided by use of a low anodizing voltage which is composed of a DC component and a superimposed AC component and with less acid concentration than many conventional hard anodizing processes. In preferred implementation of the novel process, the amount of sulfuric acid in the electrolyte can be reduced at least by half compared to the amount needed in a conventional Sanford anodizing process in which only a DC voltage is employed. That reduction in the concentration of sulfuric acid in the electrolyte is of great benefit in reducing the expense of neutralizing waste water. In addition, the novel process can be performed at higher electrolytic bath temperatures without causing degradation in the hardness of the oxide coatings; indeed, the novel process provides oxide coatings of superior characteristics. As a consequence, the amount of energy employed to cool the electrolytic bath is reduced, and energy reduction is also achieved by use of low anodizing voltages. Anodizing at low voltage also eliminates the problem of possible burning of the articles.

The invention is not to be limited by what has been shown and described except to the extent indicated in the appended claims.

What is claimed is:

1. A method for hard anodizing aluminum and aluminum alloy articles comprising the steps of:

immersing one or more of said articles in a cooled electrolyte composed of an aqueous solution of a strong acid;

applying for a predetermined time interval across said article and a cathode in said electrolyte a DC voltage with a superimposed AC voltage, the positive potential of the DC voltage component being applied to said article and the negative potential of the DC voltage component being applied to said cathode;

said DC voltage component having a value during at least a portion of said time interval substantially in the range of about 14–20 volts, said value being the highest DC voltage applied during said time interval to said articles.

2. The method of claim 1 wherein said electrolyte is an aqueous solution of sulfuric acid.

3. The method of claim 2 wherein said electrolyte includes an acidic aqueous extract additive.

4. The method of claim 3 wherein said additive is an extract sold under the trademark SANFRAN.

5. The method of claim 2 wherein said electrolyte is composed of 5.7–23% by volume of 66° Baume sulfuric acid and from 2–8% by volume of SANFRAN.

6. The method of claim 1 wherein said AC voltage is sinusoidal.

7. The method of claim 6 wherein said sinusoidal voltage has an amplitude which is about 100% of the voltage level of said DC voltage.

8. The method of claim 1 wherein the superimposed AC voltage has a peak-to-peak value about 200% of the DC component.

9. The method of claim 1 including the step of:

increasing the DC voltage component during said time interval to a final value in the range of about 14–20 volts.

10. The method of claim 1 including the steps of:

increasing the DC voltage component during said time interval to a final value in the range of about 14–20 volts; and maintaining said final value during the remainder of said time interval.

11. The method of claim 1 including the step of:

increasing the DC voltage component during said time interval to a final value in the range of about 14–20 volts while maintaining constant the ratio of the AC voltage to the DC voltage.

12. The method of claim 1 wherein said value of DC voltage component is determined for a particular aluminum alloy to provide the greatest abrasion resistance and breakdown voltage.

13. The method of claim 2 wherein said electrolyte is cooled to a temperature within the range of about 25°–60° F.

14. The method for hard anodizing aluminum and aluminum alloy articles comprising the steps of:

immersing one or more of said articles in a cooled electrolyte composed of an aqueous solution of sulfuric acid;

applying for a predetermined time interval across said article and a cathode in said electrolyte a DC voltage with a superimposed AC voltage, the positive potential of the DC voltage component being applied to said article and the negative potential of the DC voltage component being applied to said cathode, said DC voltage component with a superimposed AC voltage being applied in the following manner:

raising said DC voltage component from zero to 10 volts during a one minute interval;

increasing said DC voltage component at a rate of ½ volt per minute to a predetermined final voltage in the range of about 14–20 volts; and maintaining said final voltage constant for the remainder of said time interval.

15. The method of claim 14 wherein said final voltage is between 17 and 18 volts for the 2024 aluminum alloy to achieve substantially maximum abrasion resistance and breakdown voltage.

16. The method of claim 14 wherein said final voltage is in the range of about 15–18 volts for the 6061 aluminum alloy to achieve substantially maximum abrasion resistance and breakdown voltage.

17. The method of claim 14 wherein said final voltage is about 17 and 19 volts for the 7075 aluminum alloy to achieve substantially maximum abrasion resistance and breakdown voltage, respectively.

* * * * *

UNITED STATES PATENT AND TRADEMARK OFFICE

CERTIFICATE OF CORRECTION

PATENT NO. : 4,133,725

DATED : January 9, 1979

INVENTOR(S) : Moisey M. Lerner and James H. Morse

It is certified that error appears in the above-identified patent and that said Letters Patent are hereby corrected as shown below:

Column 5, line 16, "Frustajer" should read --Fruzstajer--.

Column 6, line 13, "((A-B/C)" should read --(A-B)/C--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*